US008129320B2

(12) United States Patent
Amann et al.

(10) Patent No.: US 8,129,320 B2
(45) Date of Patent: Mar. 6, 2012

(54) LUBRICANT OIL COMPOSITIONS TO OPTIMIZE INTERNAL COMBUSTION ENGINE PERFORMANCE

(75) Inventors: Manfred Amann, San Antonio, TX (US); Terrence Francis Alger, II, San Antonio, TX (US); Thomas W. Ryan, III, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 245 days.

(21) Appl. No.: 12/556,974

(22) Filed: Sep. 10, 2009

(65) Prior Publication Data

US 2011/0059878 A1 Mar. 10, 2011

(51) Int. Cl.
*C10L 1/18* (2006.01)
*C10M 169/04* (2006.01)

(52) U.S. Cl. ..... 508/492; 508/110

(58) Field of Classification Search ..... 508/110, 508/120, 492
See application file for complete search history.

(56) References Cited

U.S. PATENT DOCUMENTS

| | | | | |
|---|---|---|---|---|
| 7,262,155 | B2 | 8/2007 | Ryan, III | |
| 7,389,752 | B2 | 6/2008 | Alger | |
| 2007/0155631 | A1* | 7/2007 | Muir | 508/185 |
| 2009/0111721 | A1* | 4/2009 | Boffa | 508/371 |

* cited by examiner

*Primary Examiner* — Walter D Griffin
*Assistant Examiner* — Francis C Campanell
(74) *Attorney, Agent, or Firm* — Grossman, Tucker et al.

(57) ABSTRACT

The present disclosure relates to lubricant oil compositions formed from base stock oils to optimize internal combustion engine performance. Base stock oils are identified that have selected cetane number characteristics and relatively reduced reactivity to improve their associated combustion characteristics and reduce engine knock without the need to modify the engine fuel or engine parameters such as compression ratio and/or ignition timing. The base stocks may specifically include esters of dicarboxylic acids, esters of trimellitic anhydride and/or alkylated naphthalene compounds.

24 Claims, 3 Drawing Sheets

LUBRICANT OIL COMPOSITIONS TO OPTIMIZE INTERNAL COMBUSTION ENGINE PERFORMANCE

FIELD OF THE INVENTION

The present disclosure relates to lubricant oil compositions to optimize internal combustion engine performance. Lubricant oil compositions may therefore be identified, formulated and provided to offer, for example, improved knock-resistance, fuel efficiency and/or power generation in engines operating with gasoline or other alternative fuel sources.

BACKGROUND

Internal combustion engine designs often seek to operate at relatively higher power levels in an effort to improve vehicle fuel efficiency. For example, to reduce engine displacement one may use a pressure charging system, such as a turbocharger, to maintain the power and torque of a relatively large engine, which may then improve the vehicle's fuel efficiency. When a relatively smaller engine displaces a larger engine in a given vehicle, the new vehicle may have better fuel economy due to the reduction in throttling losses, as a relatively smaller engine needs to open the throttle more to achieve similar torque as in a relatively larger engine. However, as the smaller engine may then operate at higher power levels, the efficiency gains may be reduced by the presence of knock. Knock is reference to the presence of detonation or auto-ignition, resulting from relatively high temperature conditions, which typically occur at high specific power levels, causing auto-ignition of unburned gases in the cylinder. Knock may produce objectionable noise and may also lead to catastrophic engine failure.

Engine lube oil is intentionally coated on a cylinder to reduce friction and prevent ring and liner wear. Some of this lubricant may therefore enter the boundary layer of the cylinder and the combustion chamber in the end gas region (the region of the last gas to burn). It may therefore be useful to identify and formulate lubricant compositions that may provide relatively low reactivity and improved knock-resistance while otherwise maintaining the lubricating efficiency of a particular lubricant composition.

SUMMARY OF THE INVENTION

In one exemplary embodiment, the present disclosure relates to a process for providing a reduced reactivity lubricant for reducing engine knock in an internal combustion engine cylinder. The process includes providing a base stock oil having an IQT[Cetane Number]$_{(-100\%)(Base\ Stock\ Oil)}$ wherein the base stock oil is formulated for use as a lubricant in the internal combustion engine utilizing a selected fuel having a fuel cetane number wherein the following relationship is observed: IQT[Cetane Number]$_{(-100\%)(Basestock\ Oil)}$≦Fuel Cetane Number.

In another exemplary embodiment the present disclosure relates to a process for providing a reduced reactivity lubricant for reducing engine knock in an internal combustion engine cylinder comprising providing a base stock oil having an IQT[Cetane Number]$_{(-100\%)(Base\ Stock\ Oil)}$ wherein the base stock oil comprises one or more of the following: (a) esters of dicarboxylic acids; (b) esters of trimellitic anhydride; (c) alklyated naphthalene. Such base stock oil may then be formulated for use as a lubricant for an internal combustion engine utilizing a selected fuel, wherein the fuel provides an IQT[Cetane Number]$_{(-100\%)(Fuel)}$ and wherein IQT[Cetane Number]$_{(-100\%)(Basestock\ Oil)}$≦IQT[Cetane Number]$_{(-100\%)(Fuel)}$.

In yet another exemplary embodiment the present disclosure relates to a process for identifying a lubricant for reducing engine knock in an internal combustion engine cylinder comprising providing a base stock oil having an IQT[Cetane Number]$_{(-100\%)(Base\ Stock\ Oil)}$. The base stock oil is one that is formulated for use as a lubricant for an internal combustion engine utilizing a selected fuel having a fuel cetane number wherein the following relationship is observed: IQT[Cetane Number]$_{(-100\%)(Basestock\ Oil)}$≦Fuel Cetane Number In addition, to the above, the present disclosure is also directed to a lubricant composition for reducing engine knock in an internal combustion engine utilizing a selected fuel wherein said fuel has an associated cetane number, comprising: (a) a base stock oil formulated for use as a lubricant for an internal combustion engine wherein the following relationship is observed: IQT[Cetane Number]$_{(-100\%)(Basestock\ Oil)}$≦Fuel Cetane Number; and (b) one or more additives combined with the base stock oil, wherein the base stock oil is present at a concentration such that the following applies: IQT[Cetane Number]$_{(-100\%)(Lubricant)}$≦Fuel Cetane Number.

FIGURES

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 1:
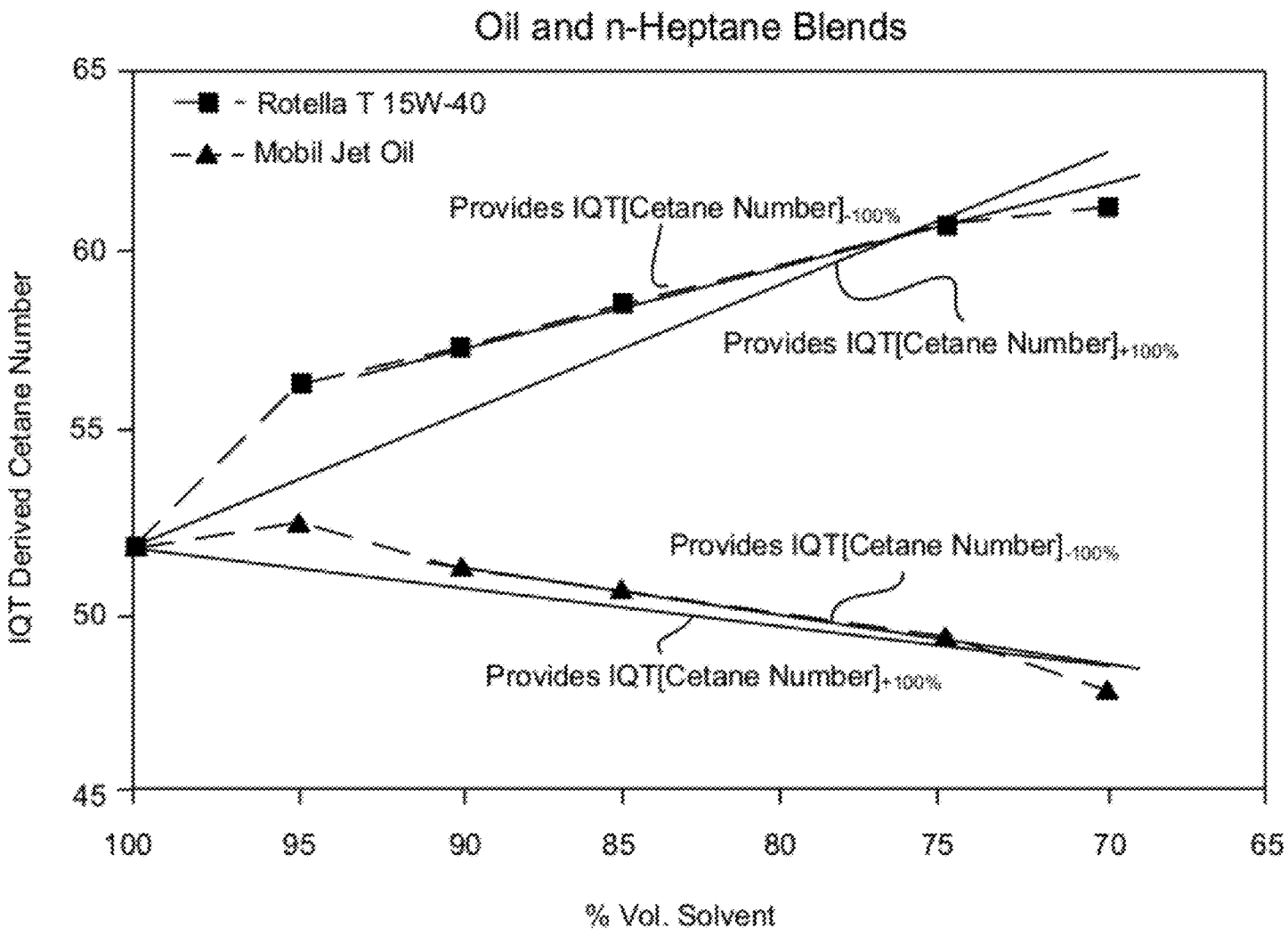
FIG. 1 is a plot of IQT derived cetane number versus % volume of solvent (n-heptane) for Rotella T 15W-40 and Mobil Jet Oil.

The lubricant composition herein, with the aforementioned cetane characteristics and reduced reactivity, may utilize certain base stock oils (hydrocarbon compounds which are liquid at room temperature) along with selected additives. The lubricant composition may therefore be formulated to provide a particular cetane number that, as discussed more fully below, serves to regulate the reactivity of the lubricant to improve its associated combustion characteristics and reduce, e.g., engine knock. In addition, this may be accomplished without the need to modify the engine fuel or engine parameters (e.g., compression ratio, ignition timing, etc.).

As noted above, the combustion characteristics of a given lubricant herein may now be evaluated and considered as a consequence of its ability to influence the combustion process within the cylinder of an internal combustion engine. More specifically, by formulating a relatively low reactivity lubricant herein with a relatively low cetane number, it has been observed that the tendency for end-gas auto-ignition may be reduced, allowing the engine to operate at relatively higher loads with more advanced combustion phasing and/or higher compression ratios (e.g., compression ratios of greater than 10:1 to 14:1). Meanwhile, lubricating efficiency may also be substantially preserved.

More preferably, it has been established herein that cetane numbers for the subject lubricants or oil base stocks may be derived from an Ignition Quality Tester (IQT) where lubricant or base stock oil, either alone or with a selected amount of heptane, is injected into a constant volume combustion chamber at a temperature of about 575° C. More specifically, the heated chamber is filled with compressed air at elevated temperature. Using a pump-line-nozzle-injector, the test lubricant may be injected and the ignition delay may then be measured. That is, the lubricant formulation or base stock oil combusts and the ignition delay is determined as the time difference between the start of injection and the start of combustion. The derived cetane number may then be calculated using an empirical inverse relationship to ignition delay. The IQT testing may also be checked against a selected standard for the cetane number calculations.

Reference to a lubricant cetane number herein may be understood as a general measure of ignition delay, i.e. the time period between the start of injection and start of combustion (ignition) of a given lubricant oil composition or the components of such composition (e.g. the oil base stock). As those skilled in the art will therefore recognize, higher cetane numbers will have shorted ignition delay periods than lower cetane numbers. Cetane numbers may be measured by a variety of techniques. For example, ASTM D613 provides a cetane number of diesel fuel in terms using a standard single cylinder, four-stroke, variable compression ratio, indirect injected diesel engine.

However, with respect to the IQT procedures utilized herein, it was recognized that the IQT derived cetane number was in fact influenced by the lubricant or base stock oil viscosity ($\eta$). This may have been the case due to the fact that the IQT™ procedure was originally developed for testing fuels as opposed to the relatively higher viscosity base stock oils or lubricant formulations. Accordingly, it was initially observed that relatively high viscosity fluids appeared to have relatively long ignition delay times which resulted in the observation of what was considered to be an artificially lower cetane number. Apparently, relatively high viscosity oils (e.g., oils with a viscosity of greater than or equal to 3.0 cSt at 100° C.) provide poor vaporization and mixing in the IQT apparatus and therefore, relatively delayed reaction timings. To therefore consider and reduce the viscosity effects of the IQT screening procedures as applied to determination of lubricant cetane numbers, the base stock oils herein were combined with relatively low viscosity solvents (n-heptane and iso-octane). Reference to a low viscosity solvent therefore may be understood as solvents having a viscosity of less than or equal to 1.0 cP at 25° C.

In particular, the IQT procedure for determination and screening of lubricant cetane numbers were developed by combining the lubricant formulation or base stock oil with a relatively low viscosity solvent and increasing concentrations of the oil or lubricant for analysis, followed by extrapolation (linear curve fitting) from the 100% solvent data point to a straight-oil condition, or 0% solvent, which may be understood herein as IQT[Cetane Number]$_{(+100\%)}$. In addition, linear curve fitting was also utilized excluding the 100% solvent condition data point which was observed to provide relatively better correlation of the data (relatively lower extrapolated or derived cetane number). This latter condition (exclusion of the 100% solvent condition in the curve fitting analysis) may be understood herein as IQT[Cetane Number]$_{(-100\%)}$. Accordingly, the base stock oils may generally be selected herein to provide an IQT[Cetane Number]$_{(-100\%)}$ of less than or equal to 70. More preferably, the IQT[Cetane Number]$_{(-100\%)}$ may be in the range of 1-70, including all values therein in increments of 1.0 (e.g., 69, 68, 67, 66, etc.). Furthermore, the IQT[Cetane Number]$_{(-100\%)(Basestock\ Oil)}$ may be less than or equal to 60 or less than or equal to 50, or less than or equal to 40, or less than or equal to 30, or less than or equal to 20, or less than or equal to 10, or less than or equal to 5.

Moreover, the IQT[Cetane Number]$_{(-100\%)}$ of the base stock oil is selected to be less than or equal to the IQT[Cetane Number]$_{(-100\%)}$ of the particular fuel that may be utilized in the subject internal combustion engine. The fuels that are contemplated herein include gasoline as well as those alternative fuels that are otherwise suitable for use in an internal combustion engine, such as ethanol, natural gas, propane, hydrogen, biodiesel, etc. For example, as gasoline may provide an IQT[Cetane Number]$_{(-100\%)}$ of about 35, the IQT [Cetane Number]$_{(-100\%)}$ of the base stock oil may therefore preferably be less than or equal to 35. In other words, the base stock oils may be selected herein to observe the following relationship:

$$\text{IQT[Cetane Number]}_{(-100\%)(Basestock\ Oil)} \leqq \text{IQT[Cetane Number]}_{(-100\%)(Fuel)}.$$

As may be appreciated, in the above relationship, reference is made to the value: IQT[Cetane Number]$_{(-100\%)(Fuel)}$. Consistent with the disclosure above, this may be understood as an extrapolated fuel cetane number and is provided by the ignition quality tester (IQT) where the fuel is now injected into a constant volume combustion chamber along with a solvent having a viscosity of less than or equal to 1.0 cP at 25° C. The ignition delay is again determined as the time difference between the start of injection and the start of combustion for different concentrations of solvent/fuel to provide corresponding cetane numbers, wherein the fuel cetane number is then determined by linear curve fitting of a plot of the determined cetane numbers versus concentration of the low viscosity solvent excluding the 100% solvent condition.

It may be noted with respect to the above relationship, as the fuel cetane number may be provided by other techniques, and does not necessarily have to be determined by IQT testing protocols alone, one may also select base stock oils such that the base stock oil observes the relationship:

$$\text{IQT[Cetane Number]}_{(-100\%)(Basestock\ Oil)} \leqq \text{Fuel Cetane Number}$$

Accordingly, the fuel cetane number may be determined by techniques such as ASTM D613 noted above. In addition, other references to fuel cetane measurements include U.S. Pat. Nos. 5,475,985 and 6,609,413, the latter of which recites a method of continually monitoring the cetane number of diesel fuels in accordance with accepted international standards.

By way of illustration, one may conduct the above referenced IQT procedure with the low viscosity solvent (n-heptane) followed by the following representative test formulations: 5.0 vol % base stock oil/95.0 vol % n-heptane; 10.0 vol % base stock oil/90.0 vol % n-heptane; 15.0 vol % base stock oil/85 vol % n-heptane; and 25.0% base stock oil/75.0 wt % n-heptane. Reference is therefore made to FIG. 1, which illustrates the IQT testing procedure herein as applied to Rotella T 15-40 and Mobil Jet Oil 254. As can be seen therein, for both samples, the IQT results for pure n-heptane provides a cetane number of about 52. By eliminating this value for the linear curve fitting method (indicated solid line) the IQT cetane number was extrapolated and for Rotella T 15-40 this value was about 77 and for Mobil Jet Oil the extrapolated value was about 36 (see also, FIG. 2). It should be noted that the curve fitting method may be accomplished utilizing two data points (e.g., 10 vol. % oil/90 vol. % n-heptane and 25% vol. % oil/75 vol. % n-heptane), however, additional data points may also be utilized.

The base stock oils may preferably include an alkylated naphthalene, which may be understood as a naphthalene compound ($C_{10}H_8$) which contains one or more alkyl groups. The alkyl groups may preferably include up to about 8 carbon atoms. For example, the alkyl groups may include methyl, ethyl, propyl, pentyl, hexyl, etc. The alkyl-substituted naphthalenes may therefore include, e.g., alpha-methylnaphthalene, dimethylnaphthalene and/or ethylnaphthalene.

Commercially available alkylated naphthalenes are available from ExxonMobil Chemical Company under the trade name SYNESSTIC™12.

The base stock oils herein may also preferably include the alkyl based esters of dicarboxylic acid (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

One particularly preferred base stock oil containing ester functionality includes the phthalate esters, commercially available from ExxonMobil under the name ESTEREX™ P81. Another suitable base stock oil containing ester functionality includes Mobil Jet Oil 254, which is identified as a hindered-ester base stock formulation that includes a built-in chemical additive package. Furthermore, another preferred base stock oil with ester functionality includes esters of trimellitic anhydride (TMA), otherwise known as trimellitate esters (TME). Such esters are also commercially available from ExxonMobil under the name ESTEREX™ TM101 Trimmellitate Esters.

Reference to a lubricant composition herein may be understood as a composition that includes a base stock oil (e.g. the alkylated naphthalene and/or ester type oils noted above) and other appropriate additives. For example, the lubricant composition may include the base stock oil at a concentration of at least about 50% wt., more preferably at a level of 75% wt. to 98% wt, even more preferably at a level of 80% wt. to 98% wt. The additives may therefore be present at a level of up to about 50% wt., more preferably in the range of 2% wt. to 20% wt. The additives may be selected from antioxidants, antiwear or extreme pressure compounds (e.g. metal alkylthophosphates, sulfurized olefins, esters of glycerols), viscosity improvers (hydrocarbons at molecular weights of 10,000 to 1,000,000, polymers and copolymers of methacrylate, butadiene, olefins or alkylated styrenes), detergents (alkali or alkaline earth metal salts of sulfonates, phenates, carboxylates, phosphates and salicylates), dispersants, pour-point depressors, corrosion inhibitors/metal deactivators, seal-compatibility additives, anti-foam agents, antirust additives and friction modifiers.

Accordingly, for a given lubricant composition, which may contain one or more of the various appropriate additives noted above, the amount of base stock oil containing an may be selected to provide an IQT[Cetane Number]$_{(-100\%)}$ of less than or equal to 70. In other words, consistent with the above, the amount of base stock oil, which is selected to itself have an IQT[Cetane Number]$_{(-100\%)}$ of less than or equal to 70, is included in the lubricant so that the lubricant observes a similar relationship. That is, the lubricant herein may be selected so that it also observes either or both of the following relationships:

$$\text{IQT[Cetane Number]}_{(-100\%)(Lubricant)} \leq \text{Fuel Cetane Number}$$

$$\text{IQT[Cetane Number]}_{(-100\%)(Lubricant)} \leq \text{IQT[Cetane Number]}_{(-100\%)(Fuel)}.$$

For example, in those situations where a particular additive may operate to increase the reactivity of the lubricant and promote knocking, base stock oils may now be selected herein to reduce this tendency in the final lubricant for a given engine, taking into consideration the type of fuel and/or a particular engine's operating parameters that may otherwise influence engine knock.

Figure 2:
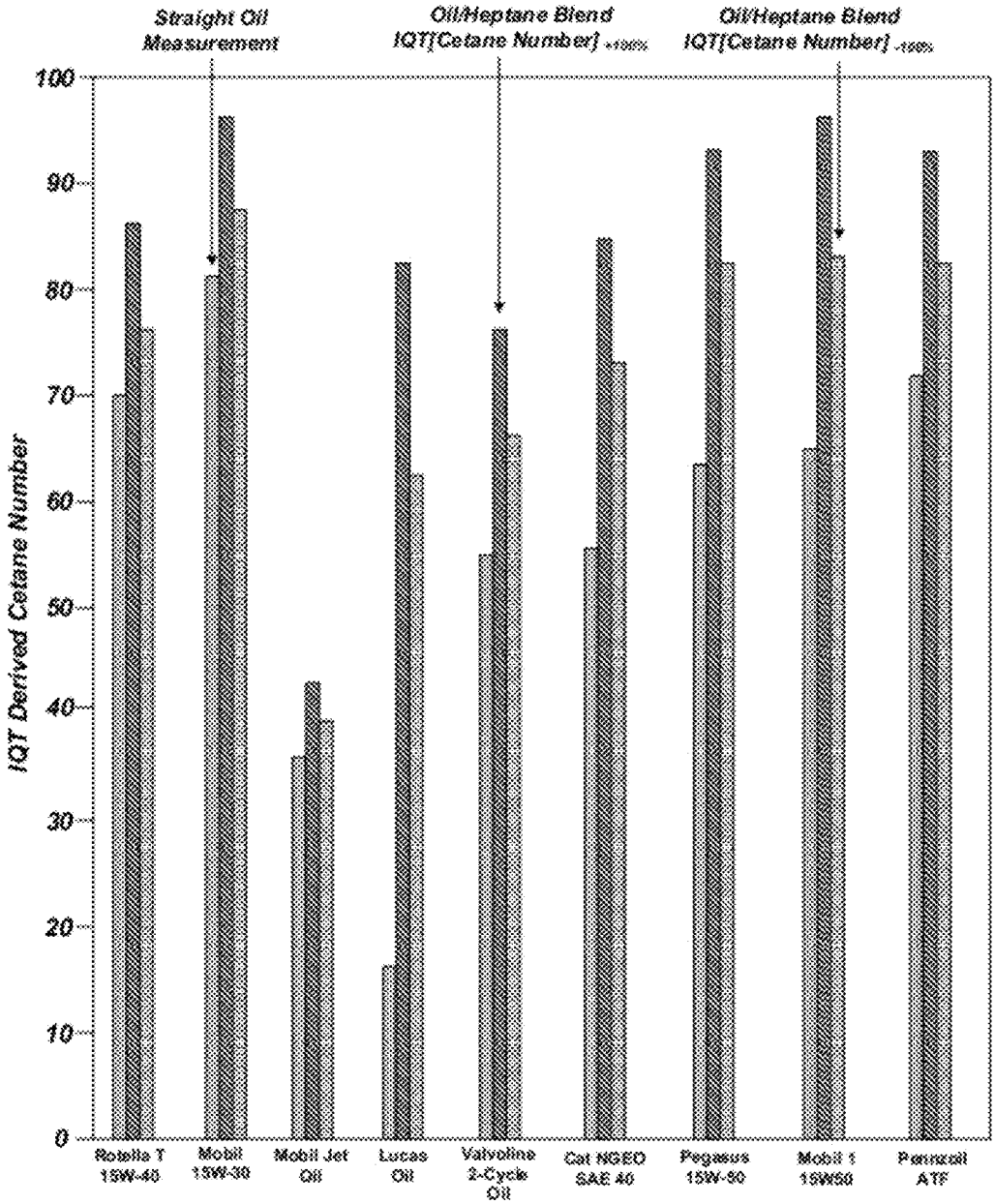
FIG. 2 is a graph of IQT derived cetane numbers for various indicated lubricants utilizing a straight-oil measurement (no solvent), extrapolated values (linear curve fit) including the 100% solvent data point or IQT[Cetane Number]$_{(+100\%)}$ and extroplated values (linear curve fit) excluding the 100% solvent data point or IQT[Cetane Number]$_{(-100\%)}$.

Attention is directed to FIG. 2 which provides a graph of the IQT derived cetane numbers for various commercially available lubricants. The actual values of the IQT[Cetane Number]$_{(-100\%)(Lubricant)}$ was as follows: ROTELLA T 15W-40=77; MOBIL 15W-30=77; MOBIL Jet Oil=36; LUCAS Oil=62; VALVOLINE 2-Cycle Oil=67; Cat NGEO SAE 40=73; PEGASUS 15W-50=80; MOBIL 1=82 and PENZOIL ATF=80. As may therefore be appreciated, the various commercial lubricants, except for MOBIL Jet Oil, indicated an IQT[Cetane Number]$_{(-100\%)(Lubricant)}$ of greater than or equal to about 70. Consistent with the disclosure here, the Mobil Jet Oil, based on an ester base stock, indicated an IQT[Cetane Number]$_{(-100\%)(Lubricant)}$ of less than 70, more specifically, a value of about 36, and therefore may now be effectively screened and selected as a candidate lubricant to reduce engine knock in an internal combustion engine.

In addition, FIG. 2 serves to experimentally confirm what was noted earlier, and that was the feature that the IQT screening protocols herein, utilizing a base stock oil or lubricant in a relatively low viscosity solvent, for IQT testing, and linear curve fitting excluding the pure solvent data point, provides more accurate values as opposed to IQT testing of the lubricant on its own. As noted, it appears that the relatively high viscosity may otherwise interfere with the IQT testing procedures, as the IQT was originally designed for relatively low viscosity and more readily volatized liquid fuel compositions.

Figure 3:
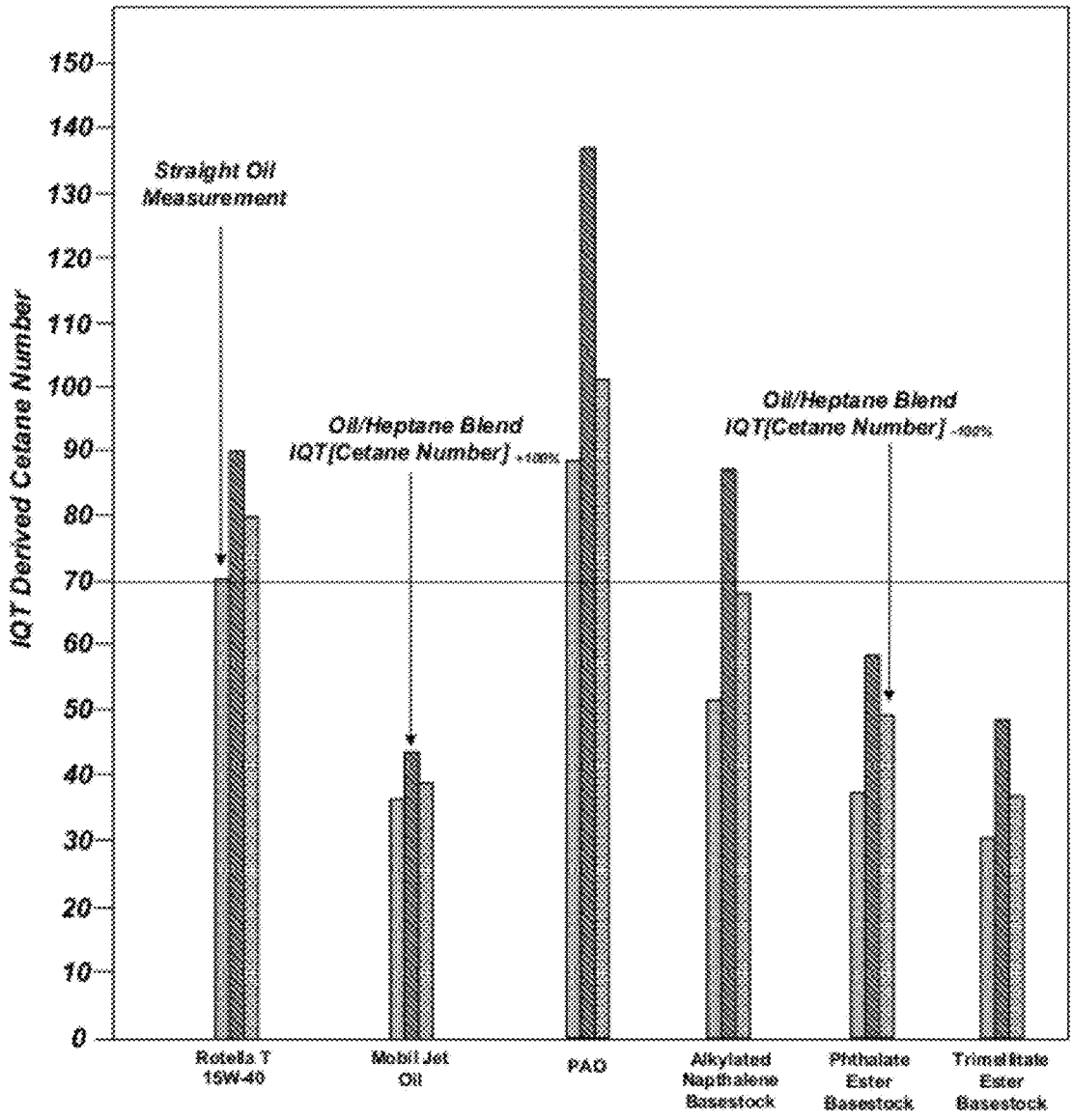
FIG. 3 is a graph of IQT derived cetane numbers for the various indicated lubricants or base stocks utilizing a straight-oil measurement (no solvent), extrapolated values (linear curve fit) including the 100% solvent data point or IQT[Cetane Number]$_{(+100\%)}$ and extroplated values (linear curve fit) excluding the 100% solvent data point or IQT[Cetane Number]$_{(-100\%)}$.

Attention is next directed to FIG. 3, which compares the IQT screening protocols herein for ROTELLA T 15W-40, MOBIL Jet Oil (containing ester base stock), Poly-alphaolefin Basestock (PAO), ExxonMobil SYNESSTIC™ 12 (alkylated naphthalenes), ExxonMobil ESTERIX™ P-81 (phthalate esters) and ExxonMobil ESTEREX™ TME (trimellitate esters). As noted earlier, the ROTELLA T 15W-40 indicated an IQT[Cetane Number]$_{(-100\%)}$ of about 77 and the MOBIL Jet Oil indicated an IQT[Cetane Number]$_{(-100\%)}$ of about 36. The PAO indicated an IQT[Cetane Number]$_{(-100\%)}$ of 103. By contrast, the alkylated naphthalene base stock indicated an IQT[Cetane Number]$_{(-100\%)}$ of 68, the phthalate ester base stock indicated an IQT[Cetane Number]$_{(-100\%)}$ of 47 and the trimellitate ester base stock indicated an IQT[Cetane Number]$_{(-100\%)}$ of 37. Accordingly, as noted and illustrated in FIG. 3, base stocks sourced from organic esters compounds such as phthalate esters and/or trimellitate esters and/or alkylated naphthalenes provided IQT[Cetane Number]$_{(-100\%)}$ of less than or equal to about 70. When such base stocks were then combined with a lubricant additive package at levels of at least about 50% wt., more preferably at a level of 75% wt. to 98% wt., even more preferably at a level of 80% wt. to 98% wt., a reduction in knock was observed. More specifically, it was observed that there was up to about a 10.0% increase in knock-limited torque at a fixed compression ratio and combustion phasing and/or an improvement in knock-limited spark advance at relatively high load conditions.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A process for providing a reduced reactivity lubricant for reducing engine knock in an internal combustion engine cylinder comprising:

providing a base stock oil having an IQT[Cetane Number]$_{(-100\%)(Base\ Stock\ oil)}$;

said base stock oil formulated for use as a lubricant for an internal combustion engine utilizing a selected fuel having a fuel cetane number wherein $$\text{IQT[Cetane Number]}_{(-100\%)(Basestock\ Oil)} \leqq \text{Fuel Cetane Number; and}$$

wherein said fuel cetane number is an extrapolated fuel cetane number and is provided by an ignition quality tester (IQT) where the fuel is injected into a constant volume combustion chamber along with a solvent having a viscosity of less than or equal to 1.0 cP at 25° C. and the ignition delay is determined as the time difference between the start of injection and the start of combustion for different concentrations of solvent to provide cetane numbers, wherein said fuel cetane number is determined by linear curve fitting of a plot of said cetane numbers versus concentration of said low viscosity solvent excluding the 100% solvent condition.

2. The process of claim 1 wherein the IQT[Cetane Number]$_{(-100\%)(Basestock\ Oil)}$ is less than or equal to 70.

3. The process of claim 1 wherein said base stock oil is further combined in a lubricant at a concentration of at least 50% by weight.

4. The process of claim 1 wherein said base stock oil is further combined in a lubricant at a concentration of 75% by weight to 99% by weight.

5. The process of claim 1 wherein the base stock oil includes esters of dicarboxylic acids.

6. The process of claim 5 wherein the esters of dicarboxylic acids include the reaction product of:

(a) one or more of the acids comprising phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, or alkenyl malonic acid; and (b) one or more of the alcohols comprising butyl alcohol, hexyl alcohol, dodecyl alcohol, 2-ethylhexyl alcohol, ethylene glycol, diethylene glycol monoether, or propylene glycol.

7. The process of claim 1 wherein the base stock oil includes esters of trimellitic anhydride.

8. The process of claim 1 wherein said base stock oil includes an alklyated naphthalene.

9. The process of claim 8 wherein said alkylated naphthalene comprises one or more of the following: alpha-methylnaphthalene, dimethylnaphthalene and/or ethylnaphthalene.

10. A process for providing a reduced reactivity lubricant for reducing engine knock in an internal combustion engine cylinder comprising:

providing a base stock oil having an IQT[Cetane Number [$_{(-100\%)(Base\ Stock\ Oil)}$wherein said base stock oil comprises one or more of the following:

(a) esters of dicarboxylic acids;

(b) esters of trimellitic anhydride;

(c) alklyated naphthalene;

said base stock oil formulated for use as a lubricant for an internal combustion engine utilizing a selected fuel having a fuel cetane number wherein $$\text{IQT[Cetane Number]}_{(-100\%)(Basestock\ Oil)} \leqq \text{Fuel Cetane Number; and}$$

wherein said fuel cetane number is an extrapolated fuel cetane number and is provided by an ignition quality tester (IQT) where the fuel is injected into a constant volume combustion chamber along with a solvent having a viscosity of less than or equal to 1.0 cP at 25° C. and the ignition delay is determined as the time difference between the start of injection and the start of combustion for different concentrations of solvent to provide cetane numbers, wherein said fuel cetane number is determined by linear curve fitting of a plot of said cetane numbers versus concentration of said low viscosity solvent excluding the 100% solvent condition.

11. The process of claim 10 wherein the IQT[Cetane Number[$_{(-100\%)(Basestock\ Oil)}$is less than or equal to 70.

12. The process of claim 10 wherein said base stock oil is further combined in a lubricant at a concentration of at least 50% by weight.

13. The process of claim 10 wherein said base stock oil is further combined in a lubricant at a concentration of 75% by weight to 99% by weight.

14. A process for identifying a lubricant for reducing engine knock in an internal combustion engine cylinder comprising:

providing a base stock oil having an IQT[Cetane Number]$_{(-100\%)(Base\ Stock\ Oil)}$;

said base stock oil formulated for use as a lubricant for an internal combustion engine utilizing a selected fuel having a fuel cetane number wherein $$\text{IQT[Cetane Number]}_{(-100\%)(Basestock\ Oil)} \leqq \text{Fuel Cetane Number; and}$$

said IQT[Cetane Number]$_{(-100\%)(Base\ Stock\ Oil)}$ comprises an extrapolated cetane number and is provided by an ignition quality tester (IQT) where the base stock oil is injected into a constant volume combustion chamber along with a solvent having a viscosity of less than or equal to 1.0 cP at 25° C. and the ignition delay is determined as the time difference between the start of injection and the start of combustion for different concentrations of solvent to provide cetane numbers, wherein said base stock oil cetane number is determined by linear curve fitting of a plot of said cetane numbers versus concentration of said low viscosity solvent excluding the 100% solvent condition; and said fuel cetane number is an extrapolated fuel cetane number and is provided by an ignition quality tester (IQT) where the fuel is injected into a constant volume combustion chamber along with a solvent having a viscosity of less than or equal to 1.0 cP at 25° C. and the ignition delay is determined as the time difference between the start of injection and the start of combustion for different concentrations of solvent to provide cetane numbers, wherein said fuel cetane number is determined by linear curve fitting of a plot of said cetane numbers versus concentration of said low viscosity solvent excluding the 100% solvent condition.

15. The process of claim 10 wherein the esters of dicarboxylic acids include the reaction product of:

(a) one or more of the acids comprising phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, or alkenyl malonic acid; and (b) one or more of the alcohols comprising butyl alcohol, hexyl alcohol, dodecyl alcohol, 2-ethylhexyl alcohol, ethylene glycol, diethylene glycol monoether, or propylene glycol.

16. The process of claim 10 wherein said alkylated naphthalene comprises one or more of the following: alpha-methylnaphthalene, dimethylnaphthalene and/or ethylnaphthalene.

17. The process of claim 14 wherein the IQT[Cetane Number]$_{(-100\%)(Basestock\ Oil)}$ is less than or equal to 70.

18. The process of claim 14 wherein said base stock oil is further combined in a lubricant at a concentration of at least 50% by weight.

19. The process of claim 14 wherein said base stock oil is further combined in a lubricant at a concentration of 75% by weight to 99% by weight.

20. The process of claim 14 wherein the base stock oil includes esters of dicarboxylic acids.

21. The process of claim 20 wherein the esters of dicarboxylic acids include the reaction product of:

(a) one or more of the acids comprising phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, or alkenyl malonic acid; and (b) one or more of the alcohols comprising butyl alcohol, hexyl alcohol, dodecyl alcohol, 2-ethylhexyl alcohol, ethylene glycol, diethylene glycol monoether, or propylene glycol.

22. The process of claim 14 wherein the base stock oil includes esters of trimellitic anhydride.

23. The process of claim 14 wherein said base stock oil includes an alklyated naphthalene.

24. The process of claim 23 wherein said alkylated naphthalene comprises one or more of the following: alpha-methylnaphthalene, dimethylnaphthalene and/or ethylnaphthalene.

* * * * *